United States Patent [19]

Rogers, Jr.

[11] Patent Number: 4,976,372

[45] Date of Patent: Dec. 11, 1990

[54] HIGH-PRESSURE HYDRAULIC GUN

[75] Inventor: Elmer V. Rogers, Jr., North Olmsted, Ohio

[73] Assignee: The Pipe Line Development Company, Westlake, Ohio

[21] Appl. No.: 364,802

[22] Filed: Jun. 9, 1989

[51] Int. Cl.[5] ..... B65D 88/54

[52] U.S. Cl. ..... 222/324; 222/389; 222/527; 184/39

[58] Field of Search ..... 222/325–327, 222/130, 389, 395, 334, 324, 527; 184/39

[56] References Cited

U.S. PATENT DOCUMENTS

| | | | |
|---|---|---|---|
| 923,550 | 6/1909 | Mikorey | 222/389 |
| 1,040,513 | 10/1912 | Colson | 222/389 |
| 1,175,267 | 3/1916 | Jacobs | 222/389 |
| 1,571,307 | 2/1926 | Tikalsky | 222/389 |
| 1,751,128 | 3/1930 | Cocks | 184/39 X |
| 4,201,318 | 5/1980 | Adams | 222/389 X |
| 4,592,721 | 6/1986 | Charlebois et al. | 222/389 X |

*Primary Examiner*—Andres Kashnikow
*Assistant Examiner*—Gregory L. Huson
*Attorney, Agent, or Firm*—Pearne, Gordon, McCoy & Granger

[57] ABSTRACT

A hydraulic gun for injecting sealant including an elongated barrel in which a floating piston separates a bore onto a material receiving chamber and a hydraulic fluid chamber. A manual hydraulic fluid pump assembly is mounted on the barrel in parallel juxtaposition. Mounting blocks serve to join the hydraulic pump assembly to the barrel and to provide support feet for the gun. The hydraulic pump is mounted on the barrel in a manner that permits the gun to be operated in a vertical orientation with continued supply of hydraulic fluid.

12 Claims, 3 Drawing Sheets

HIGH-PRESSURE HYDRAULIC GUN

BACKGROUND OF THE INVENTION

The invention relates to apparatus for injecting sealant or other material under high pressure and, more particularly, relates to improvements in portable manually operated high-pressure injection apparatus.

DESCRIPTION OF THE PRIOR ART

Portable manually operated injection apparatus is useful, for example, in pipeline maintenance where such apparatus is employed to force highly viscous sealants into pipe fittings to seal leakage paths while a pipeline is in service. It is necessary for a gun to deliver sealant material to an injection port at high pressures reaching 7,500 psi, for example.

For versatility, it is important that a sealant gun be portable by virtue of compactness and lightweight. Additionally, for full utility, it is important that a gun be usable in close quarters and be operational in a vertical orientation. One prior art high-pressure sealant gun, marketed by the assignee of the present invention, relies on a hydraulic fluid bag or diaphragm to contain a supply of hydraulic working fluid and permit operation in essentially any orientation. While permitting the gun to be operated in convenient orientations, the bag or diaphragm has the disadvantage of developing leaks from cracks which may occur after extended periods of use. This prior art pump construction is relatively expensive to manufacture, is relatively heavy to carry and/or support during use and is subject to breakage if struck at a vulnerable point such as the pump piston area.

SUMMARY OF THE INVENTION

The invention provides an improved high-pressure hydraulic gun for injecting sealant or other flowable material that, compared to the prior art, is simpler in construction, more durable in service, and more convenient to carry and use. As disclosed, the gun is constructed by combining a general purpose hydraulic hand pump assembly with a special barrel and piston assembly that form a material receiving chamber and a hydraulic pressure chamber. The overall size of the gun is reduced by mounting the pump assembly relative to the barrel so that an elongated reservoir of the pump assembly extends alongside and in parallel relation to a major portion of the length of the barrel.

Mounting of the pump assembly to the barrel is advantageously accomplished by providing mounting points that cooperate with the bracket feet regularly provided on the pump assembly. As disclosed, these mounting points are established by blocks which encircle the barrel from the pump assembly. On an opposite side of the barrel, these blocks form support feet for the whole gun assembly enabling it to stably rest on a horizontal planar surface such as a floor or table or be supported against a vertical planar surface such as a wall. The resulting arrangement of the various components of the gun capitalizes on the original ergonometrics and kinematics of the pump assembly and augment the same by disposing the additional mass of the barrel assembly at a location, in normal usage, beneath the pump assembly where inertia of the barrel tends to stabilize the assembly for smooth manual pumping operation. The cylinder housing of the pump assembly, in accordance with the invention, is mounted adjacent the hydraulic fluid chamber end of the barrel so that the gun can be used in a vertical orientation when convenient or necessary without loss of fluid supply from the reservoir to the pump. A strap provides means to releasably lock the pump handle in a position parallel to the barrel thereby allowing the same to be used as a convenient carrying grip. By utilizing a general purpose commercially available hydraulic hand pump in the construction of the gun, manufacturing costs are greatly reduced without sacrificing quality or reliability.

DETAILED DESCRIPTION OF THE PREFERRED EMBODIMENT

Figure 1:
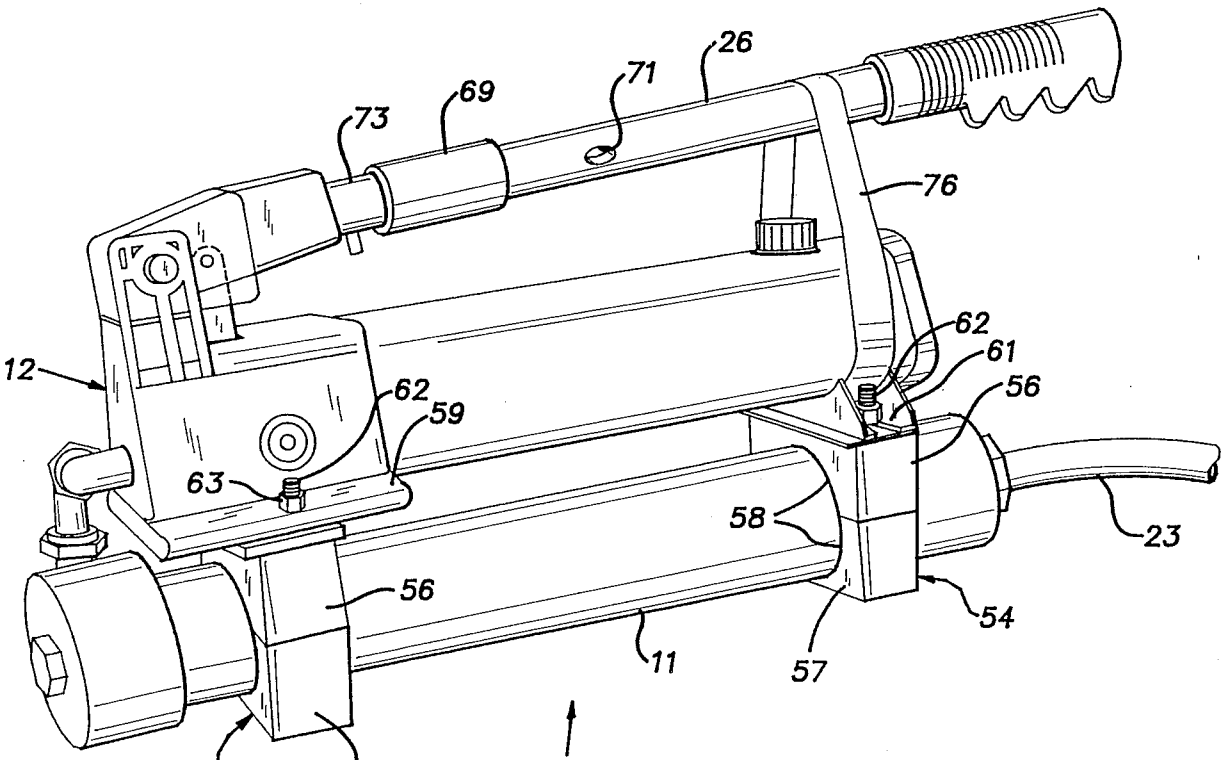
FIG. 1 is a perspective view of a hydraulic gun constructed in accordance with the invention.
Figure 2:
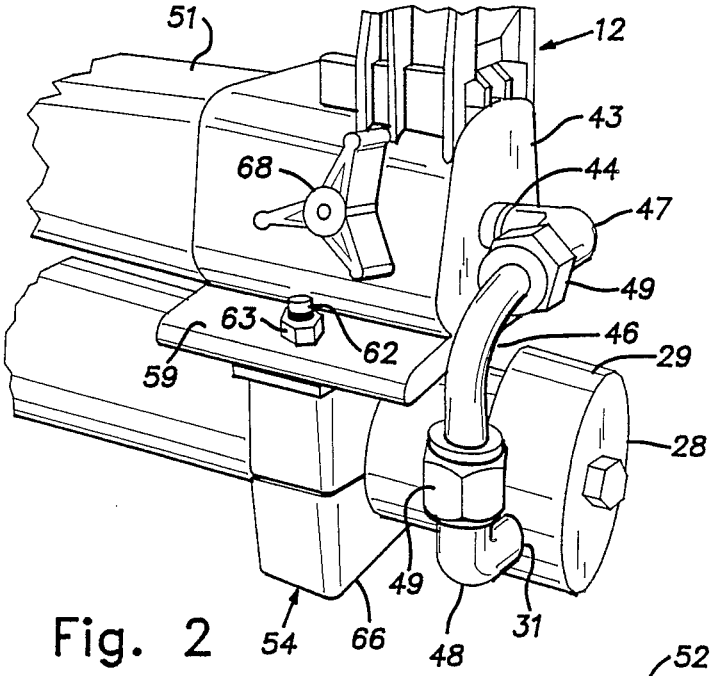
FIG. 2 is a fragmentary perspective view of the pump end of the gun shown in FIG. 1.
Figure 4:
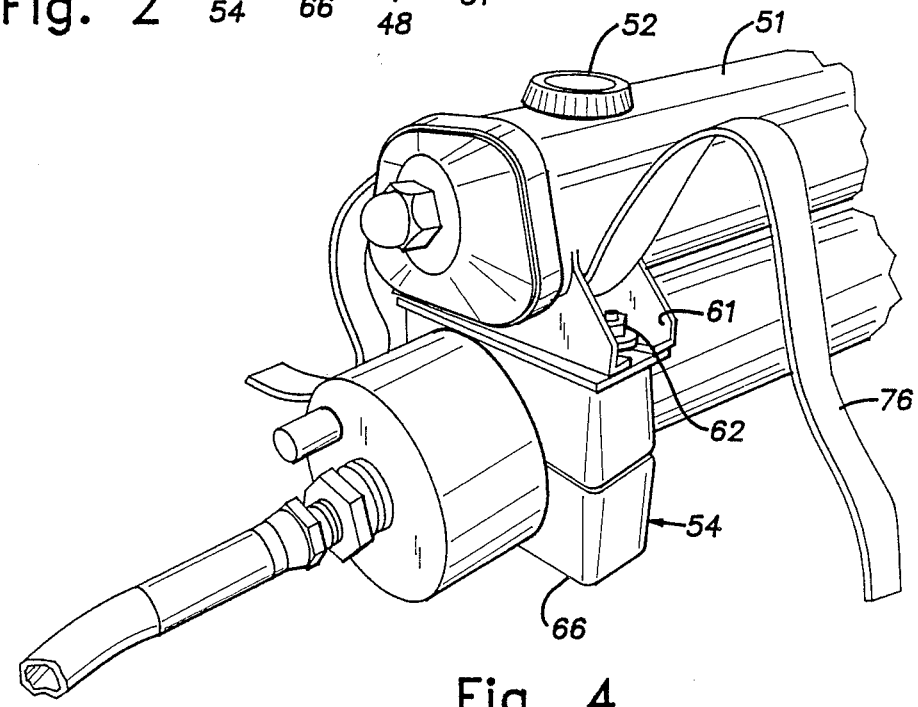
FIG. 4 is a fragmentary, perspective view of a discharge end of the hydraulic gun.
Figure 3:
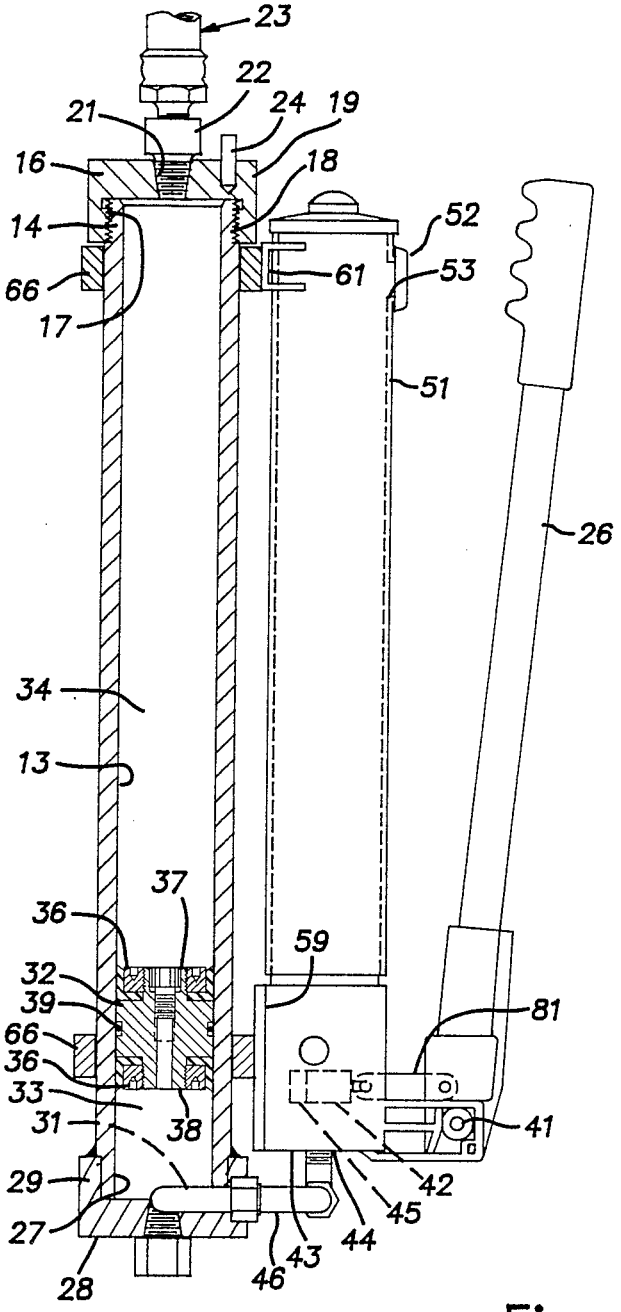
FIG. 3 is a side view of the hydraulic gun with a barrel forming a material charge receiving chamber and a hydraulic fluid pressure chamber in longitudinal cross-section.

A hydraulic gun 10 includes an elongated generally cylindrical barrel 11 and a hydraulic pump assembly 12. The barrel 11, shown in cross-section in FIG. 3, is formed of steel or other suitable high-strength material and has a central cylindrical bore 13 extending substantially along its full length. At a discharge end 14, the barrel bore 13 is closed by a steel cap 16 having internal tapered threads 17 mating with external tapered threads 18 on the barrel 11.

An end wall 19 of the cap 16 has a central threaded bore 21 which receives an end fitting 22 of a high-pressure hydraulic hose assembly 23. A projecting pin 24 is pressed into an off-center, axially oriented, blind hole in the cap end wall 19. The pin 24 is engaged with an appropriate tool which as disclosed below is conveniently embodied as a handle 26 for the pump assembly 12 for manually turning the cap 16 on and off the barrel threads 18.

An opposite end 27 of the barrel 11 is permanently closed by a steel cap 28 that is socket welded to the body of the barrel. A sidewall or skirt 29 of the cap 28 has an internally threaded port 31 that communicates with the interior of the bore 13. A piston assembly 32 is slidably disposed within the bore 13 and separates its volume into a hydraulic fluid chamber 33 and a material receiving chamber 34. The piston assembly 32 includes a pair of generally conventional sealing cups 36 of leather or other suitable material, one adjacent each of its end faces 37, 38. A sealing O-ring 39 is received in a peripheral groove at the mid-length of the piston assembly 32. The cups 36 and O-ring 39 provide a fluid-tight seal between the surface of the bore 13 and the piston assembly 32.

The hydraulic pump assembly 12 is a self-contained unit of generally conventional construction such as the type sold under the registered trademark ENERPAC, specifically a current model designated P-142, for example. The general class of such pumps is shown, for example, in U.S. Design Pat. No. 270,912.

The pump assembly includes a manually operated handle previously designated by the numeral 26 pivoted about a pin 41. The handle 26 causes a piston 42 (shown schematically in phantom) within an associated cylinder 45 in a housing 43 of the pump assembly 12 to reciprocate in a known manner when it is pivoted about the pin 41. The piston 43 forces hydraulic fluid out of a threaded port 44. The port 44 is connected to the hydraulic chamber port 31 by a high-pressure steel tubing line 46 and conventional high-pressure steel compression fittings 47, 48. The line 46 thus provides an external connection between the hydraulic pump assembly 12 and the hydraulic fluid chamber 33. The bodies of the fittings 47, 48 are respectively threaded into the ports of the pump 44 and hydraulic fluid chamber 31.

Associated with each fitting 47, 48 is a compression nut 49 and a ferrule (not shown) within such nut and these nuts are removably tightened on the fitting bodies 47, 48. As shown, the fitting bodies 47, 48 are L-shaped and the steel tubing line 46 is bent into still another L-shape to provide a convenient reusable connection between the pump 12 and barrel 11.

The pump assembly 12 has an elongated reservoir 51 of trapezoidal cross-section. The reservoir 51, which forms the majority of the length of the assembly 12, contains hydraulic fluid which is supplied to the cylinder 45 of the pump piston 42. The reservoir 51 is mounted alongside the barrel 11 with its longitudinal axis parallel to that of the barrel. As seen, the reservoir 51 extends along a major portion of the length of the barrel 11. The reservoir 51 and barrel 11 are mounted together by a pair of longitudinally spaced mounting blocks 54. Each block 54 is split into two mating sections 56, 57 that have semi-circular formations 58 that cooperate to form a circular bore which tightly grips the exterior of the barrel 11. Each block 54 is associated with a bracket foot 59, 61 of the pump assembly 12. At each block 54, a pair of threaded fasteners 62 are assembled through aligned holes in the bracket feet 59, 61 and blocks on opposite sides of the barrel 11. The fasteners 62 are conveniently threaded into threaded holes in the lower mating sections 57, and pass through clearance holes in the upper sections 56 and through aligned holes in the webs of the associated bracket feet 59 or 61.

Nuts 63 are tightened on the fasteners 62 to draw the block sections 56, 57 together tightly on the barrel 11 and the bracket feet 59, 61 against the upper block sections 56. The blocks 54 underly and form extensions of the pump assembly brackets 59, 61. Lower flat surfaces 66 of the mounting blocks 54 are coplanar with each other and are adapted to rest solidly on a horizontal surface such as a floor or table so that downward vertical loads on the pump assembly 12 are positively supported by the blocks 54. Thus, the stability of the pump assembly 11 is improved from its original design where it rests on the bracket feet 59, 61 since the barrel assembly 11 increases the effective mass of the pump assembly 12 and lowers its center of gravity without diminishing its original solid footing.

The capacity of the reservoir 51 is at least equal to the volume of the hydraulic fluid chamber 33 when the piston assembly 32 is fully displaced towards the end of the barrel 11 forming the material receiving chamber 34. A removable cap 52 is threaded into a fill port 53 in a wall of the reservoir 51 adjacent the discharge end 14 of the barrel 11 for replenishing the supply of hydraulic fluid contained in the reservoir 51.

The pump assembly 12 includes a release valve 68 which is turned clockwise to an operating position in which a fluid flow return path from the pump piston chamber 45 and the line 46 to the reservoir 51 is blocked in a known manner. The release valve 68, alternatively, is turned counter-clockwise to allow return flow from the pump piston chamber 45 and the line 46 to the reservoir 51 in a known manner. The material receiving chamber 34 is filled with a material that is flowable under pressure. This material can be an injectable sealant that, for example, is in stick form as is known in the art. The chamber 32 is conveniently opened using the handle 26 as a tool. The handle 26 separates with a coupling sleeve 69 and a hole 71 in its sidewall is positioned over the pin 24. The end fitting 22 acts as a fulcrum for the handle 26 allowing the pin 24, with the cap 16 to be turned on the axis of the barrel 11.

With the chamber 34 opened, the piston assembly 32 is retracted in the bore 13 by manually pushing it with the handle 26. The release valve 68 is in the counter-clockwise or open position during this time. The flowable material or sealant is positioned in the chamber 34 and the cap 16 is reinstalled. The handle 26 is repositioned on the handle stub, designated 73 in preparation for use of the pump assembly 12. The release valve 68 is turned clockwise to close off the bypass or return circuit to the reservoir and the pump assembly 12 is operated by manually swinging or pivoting the handle 26 about the pivot pin 41 causing a connecting lever 81 to reciprocate the piston 42. Hydraulic fluid is pumped from the pump piston chamber 45. The pressure of fluid in the chamber 33 forces the piston assembly 32 against the sealant material in the chamber 34 which is expressed from this chamber through the bore 21 and hose assembly 23. After the chamber 34 and hose assembly 23 have been purged of air, a connecting fitting (not shown) on the end of the hose assembly 23 is connected to a mating fitting on a device to be sealed or otherwise injected with material.

An important feature of the hydraulic gun 10 is its ability to be used in a vertical position with the discharge port 21 pointed in an upward direction. This permits the gun 10 to be used in confined areas and be supported with the blocks 54 against vertical surfaces to absorb pumping forces on the handle 26. This vertical operation is permitted by the disclosed organization of parts wherein with the discharge port 21 pointed upwardly the reservoir 51 is above the pump housing 43 so that hydraulic fluid in the reservoir will continue to feed the hydraulic pump assembly 12. Similarly, the fill port cap 52 is at a relatively high point on the reservoir when the discharge port 21 is pointed upwardly. The disclosed gun 10 is relatively light in weight and is readily carried by means of the handle 26 which during transit is held in a downward position parallel to the axis of the barrel 11 by a strap adjacent the discharge end 14 of the barrel 11. The strap 76 is wrapped about the reservoir 51 through the bracket foot 61. The strap 76 can include Velcro components at its end enabling it to be opened and closed about the handle 26.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

I claim:

1. A high-pressure hydraulic gun for injecting flowable sealant or the like comprising a barrel having walls that form an interior cylindrical bore closed at opposite ends, a piston assembly sealed with and slidable within the bore, the piston assembly dividing the barrel bore into a hydraulic fluid pressure chamber and a material receiving chamber, a hydraulic pump assembly including a pump piston housing having an internal cylinder, a piston within the pump cylinder, a manually operable handle pivotal on the housing, means connecting the handle to the piston whereby pivotal movement of the handle causes reciprocation of the piston, a reservoir for hydraulic fluid formed by a hollow elongated chamber having one end rigidly directly attached to the pump housing, the ends of the pump assembly being formed respectively by the pump housing and an end of the reservoir opposite said one end, the piston being adapted to receive hydraulic fluid from the reservoir and pump it out of the housing through an associated port, a port on a wall of the cylinder communicating with the hydraulic fluid chamber, means connecting the pump port to the hydraulic fluid chamber port whereby fluid pumped by said pump piston is conducted into said hydraulic fluid chamber, means mounting said pump assembly alongside said barrel, said mounting means including elements adjacent each end of the pump assembly extending between and rigidly joining the pump assembly to the barrel, said elongated reservoir extending alongside a substantial portion of the length of said barrel, the mounting means avoiding excessive stress on the pump housing and the pump port connecting means by transferring at least a portion of any forces tending to displace the pump assembly relative to the barrel directly to the barrel at a location adjacent the opposite end of the reservoir, said gun including supporting surface means adapted to support said gun on a surface parallel to said barrel, said supporting surface means including elements defining a flat plane, said elements being disposed at locations spaced axially along the barrel a distance substantially at least as great as the length of said reservoir, said flat plane defined by said elements of said supporting surface means being on a side of said barrel opposite said pump assembly whereby pumping forces on said handle towards said barrel are adapted to be transferred by said elements to a floor surface or the like in a stable manner.

2. A hydraulic gun as set forth in claim 1, including means to releasably maintain said handle in substantially parallel relation to said barrel to thereby enable said handle to be used as a hand grip for transporting said gun.

3. A hydraulic gun as set forth in claim 1, wherein said pump assembly is mounted on said barrel with said handle disposed on a side of the pump assembly opposite that side of the pump assembly facing the barrel.

4. A hydraulic gun as set forth in claim 1, wherein said barrel includes an end cap removably threaded on an end of the barrel associated with said material receiving chamber.

5. A hydraulic gun as set forth in claim 4, wherein said end cap includes a material discharge port.

6. A hydraulic gun as set forth in claim 5, wherein said material discharge port is formed by a circular hole coincident with the axis of said barrel bore.

7. A hydraulic gun as set forth in claim 6, wherein said gun includes a high-pressure flexible hose assembly connected to said discharge port.

8. A hydraulic gun as set forth in claim 1, wherein said mounting means includes bracket means for supporting said hydraulic pump assembly on said barrel at points spaced axially along said barrel.

9. A hydraulic gun as set forth in claim 8, wherein said bracket means provides said supporting surface means.

10. A hydraulic gun as set forth in claim 9, wherein said bracket means comprises a pair of bodies engaging the exterior of the barrel at points spaced apart a major fraction of the length of said barrel.

11. A hydraulic gun as set forth in claim 10, wherein said pump assembly is secured to said bracket means by threaded fasteners.

12. A hydraulic gun as set forth in claim 11, wherein said pump assembly is mounted on said barrel with the pump piston adjacent an end of the barrel associated with said hydraulic chamber.

* * * * *